US008282505B2

(12) United States Patent
Solheim et al.

(10) Patent No.: US 8,282,505 B2
(45) **Date of Patent: *Oct. 9, 2012**

(54) GROOVES OF GOLF CLUB HEADS AND METHODS TO MANUFACTURE GROOVES OF GOLF CLUB HEADS

(75) Inventors: John A. Solheim, Phoenix, AZ (US); David L. Petersen, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/237,293

(22) Filed: Sep. 20, 2011

(65) Prior Publication Data

US 2012/0010016 A1 Jan. 12, 2012

Related U.S. Application Data

(63) Continuation of application No. 12/535,868, filed on Aug. 5, 2009, now Pat. No. 8,066,586.

(60) Provisional application No. 61/087,158, filed on Aug. 7, 2008.

(51) Int. Cl.
*A63B 53/04* (2006.01)

(52) U.S. Cl. ..... 473/331

(58) Field of Classification Search ..... 473/324–350
See application file for complete search history.

(56) References Cited

U.S. PATENT DOCUMENTS

| | | | | | |
|---|---|---|---|---|---|
| 4,508,349 | A * | 4/1985 | Gebauer et al. | 473/330 |
| 4,550,914 | A * | 11/1985 | McCallister | 473/242 |
| 4,792,140 | A * | 12/1988 | Yamaguchi et al. | 473/331 |
| 5,090,702 | A * | 2/1992 | Viste | 473/331 |
| 5,591,092 | A * | 1/1997 | Gilbert | 473/330 |
| 5,601,501 | A * | 2/1997 | Kobayashi | 473/350 |
| 5,611,742 | A * | 3/1997 | Kobayashi | 473/345 |
| 5,676,605 | A * | 10/1997 | Kobayashi | 473/331 |
| 5,688,186 | A * | 11/1997 | Michaels et al. | 473/290 |
| 5,711,722 | A * | 1/1998 | Miyajima et al. | 473/346 |
| 5,735,755 | A * | 4/1998 | Kobayashi | 473/342 |
| 5,755,626 | A * | 5/1998 | Shira | 473/330 |
| 5,762,566 | A * | 6/1998 | King et al. | 473/328 |
| 5,766,087 | A * | 6/1998 | Kawamatsu | 473/290 |
| D481,432 | S * | 10/2003 | Greene | D21/748 |
| 6,719,645 | B2 * | 4/2004 | Kouno | 473/345 |
| D490,129 | S * | 5/2004 | Greene | D21/748 |
| 7,066,833 | B2 * | 6/2006 | Yamamoto | 473/330 |
| 7,455,597 | B2 * | 11/2008 | Matsunaga | 473/329 |
| D596,687 | S * | 7/2009 | Bezilla et al. | D21/759 |
| D603,009 | S * | 10/2009 | Bezilla et al. | D21/759 |
| 7,749,098 | B2 * | 7/2010 | Johnson | 473/330 |
| 7,794,335 | B2 * | 9/2010 | Cole et al. | 473/342 |
| 7,914,394 | B2 * | 3/2011 | Cole et al. | 473/332 |
| 7,922,602 | B2 * | 4/2011 | Johnson | 473/330 |
| 7,942,758 | B2 * | 5/2011 | Nakamura | 473/340 |
| 8,021,245 | B2 * | 9/2011 | Beach | 473/331 |
| 8,066,586 | B2 * | 11/2011 | Solheim et al. | 473/330 |

* cited by examiner

*Primary Examiner* — Alvin Hunter

(57) ABSTRACT

Embodiments of grooves of golf club heads and methods to manufacture grooves of golf club heads are generally described herein. Other embodiments may be described and claimed.

20 Claims, 7 Drawing Sheets

GROOVES OF GOLF CLUB HEADS AND METHODS TO MANUFACTURE GROOVES OF GOLF CLUB HEADS

CROSS-REFERENCE TO RELATED APPLICATION

This application is a continuation of U.S. patent application Ser. No. 12/535,868, filed Aug. 5, 2009, now U.S. Pat. No. 8,066,586 which claims the benefits of U.S. Provisional Application 61/087,158 filed Aug. 7, 2008, the entire disclosures of which are incorporated by reference.

TECHNICAL FIELD

The present disclosure relates generally to golf equipment, and more particularly, to grooves of golf club heads and methods to manufacture grooves of golf club heads.

BACKGROUND

Typically, a golf club head may include a club face with a plurality of parallel grooves extending between the toe end and the heel end. In particular, the plurality of grooves in an iron-type club head may clear out water, sand, grass, and/or other debris between a golf ball and the club face. Golf club faces may have grooves with various shapes such as squared or box-shaped grooves. V-shaped grooves, or U-shaped grooves.

DESCRIPTION

In general, grooves of golf club heads and methods to manufacture grooves of golf club heads are described herein. Golf equipment related to the methods, apparatus, and/or articles of manufacture described herein may be conforming or non-conforming to the rules of golf at any particular time. Further, the figures provided herein are for illustrative purposes, and one or more of the figures may not be depicted to scale. The apparatus, methods, and articles of manufacture described herein are not limited in this regard.

Figure 1:
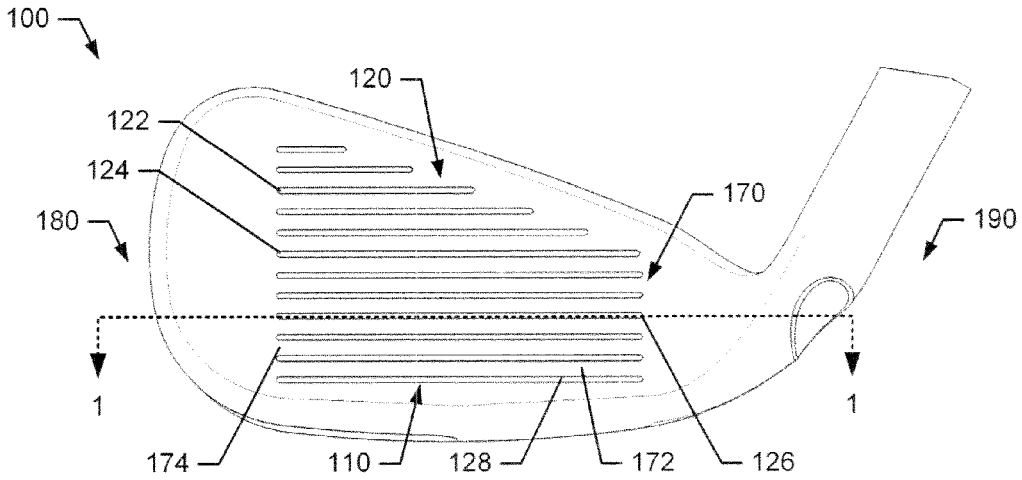
FIG. 1 is a perspective diagram representation of an example golf club head according to an embodiment of the methods, apparatus, and articles of manufacture described herein.

In the example of FIG. 1, a golf club head 100 may include a club face 110. In general, the club face 110 may be used to impact a golf ball (not shown). For example, the club face 110 may be made of titanium material, titanium alloy material, titanium-based material, or other suitable types of material. The club face 110 may include one or more grooves 120 (e.g., generally shown as 122, 124, 126, and 128) and one or more land portions 170 (e.g., generally shown as 172 and 174). In general, two or more of the grooves 120 may be parallel to each other. For example, the grooves 122 and 124 may be parallel to each other. One or more of the grooves 120 may be substantially straight and extend between a toe end 180 and a heel end 190 of the golf club head 100. Two adjacent grooves such as grooves 122 and 124 may be separated by one of the land portions 170 (e.g., the land portion 172). That is, the land portion 172 may join the grooves 122 and 124. Although FIG. 1 lay depict an iron-type club head, the apparatus, methods, and articles of manufacture described herein may be applicable other types of club head (e.g., a driver-type club head, a fairway wood-type club head, a hybrid-type club head, a putter, etc.).

The shape of the grooves 120 may vary based on the shape of the tool to manufacture the grooves 120. As described in detail below, the depth and/or the width of the grooves 120 may progressively increase from the toe end 180 and/or the heel end 190. The apparatus, methods, and articles of manufacture described herein are not limited in this regard.

Figure 2:
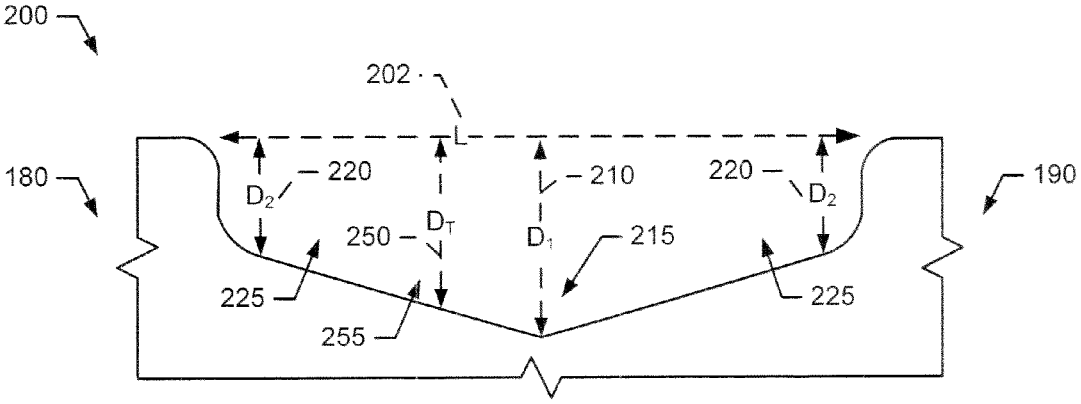
FIG. 2 depicts a cross-sectional view of a first example groove along line 1-1.

Referring to FIG. 2, for example, a groove 200 may extend a length (L) 202 between the toe end 180 and the heel end 190 (FIG. 1). Instead of having a uniform or constant depth from one end to another (e.g., between the toe end 180 and the heel end 190), the groove 200 may include two or more depths, generally shown as a first depth ($D_1$) 210 and a second depth ($D_2$) 220 (e.g., variable depth). The groove 200 may include a first depth portion 215 associated with the first depth 210. The second depth portion(s) 225 of the groove 200 located at or proximate to the toe end 180 and the heel, end 190 may be associated with the second depth 220.

In general, the depth of the groove 200 may gradually transition between the depth portions 215 and 225 (e.g., in a linear manner). For example, the groove 200 may include transition depths ($D_T$), generally shown as 250, which may be associated with a transition depth portion(s) 255. Transition depth portion(s) 255 may extend between the first and second depth portions 215 and 225. The first depth 210 may be a maximum depth of the groove 200 whereas the second depth 220 may be a minimum depth of the groove 200. Accordingly, the transition depth 250 may be less than the first depth 210 but greater than second depth 220. In one example, the first depth 210 may be greater than 0.020 inches (e.g. $D_1$>0.020 inches). In another example, the first depth 210 may be greater than 0.020 inches but less than 0.022 inches (e.g. 0.020 inches<$D_1$<0.022 inches). As a result, the groove 200 may provide a relatively larger channel at or proximate to a center of the length 202 relative to the toe end 180 and the heel end 190 to clear out water, sand, grass, and/or other debris between a golf ball (not shown) and the club face 110 before, during, and/or after impact on the club face 110 by the golf ball.

While the above example may describe a symmetrical configuration, the methods, apparatus, and articles of manufacture may include asymmetrical configurations. For example, although FIG. 2 may depict the first depth 210 being located at or proximate to the center of the length 202, the first depth 210 may be located at or proximate to other portions of the groove 200. The methods, apparatus, and articles of manufacture are not limited his regard.

Figure 3:
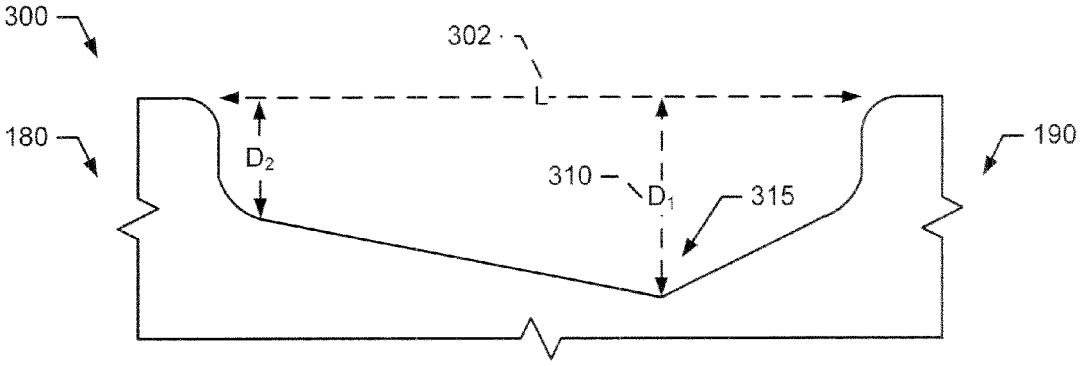
FIG. 3 depicts a cross-sectional view of a second example groove along line 1-1.
Figure 4:
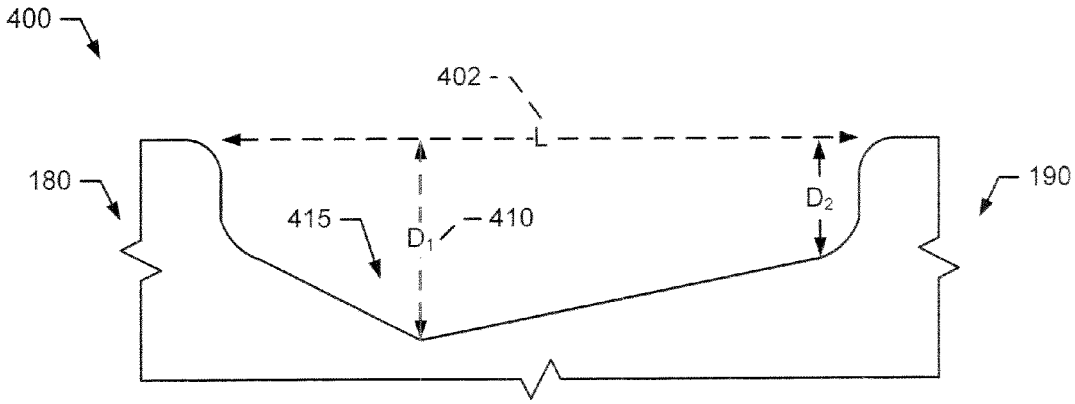
FIG. 4 depicts a cross-sectional view of a third example groove along line 1-1.
Figure 5:
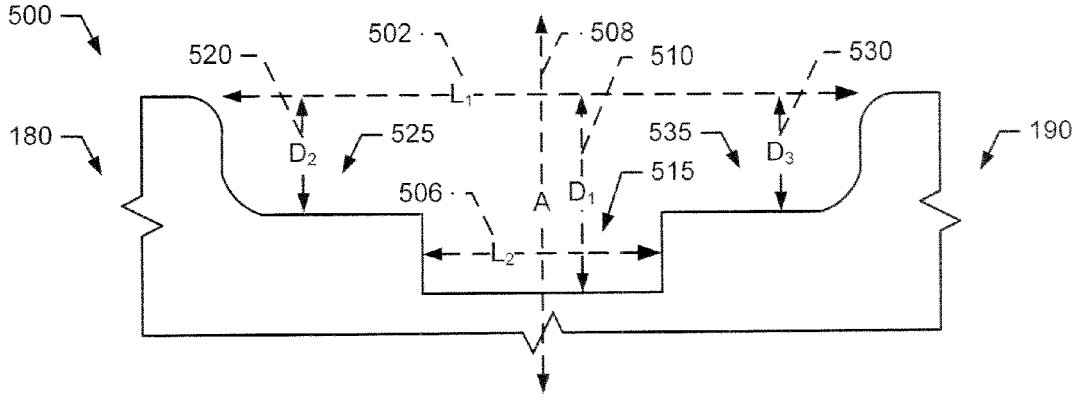
FIG. 5 depicts a cross-sectional view of a fourth example groove along line 1-1.

Turning to FIGS. 3 and 4, for example, a groove 300 may extend a length (L) 302 between the to end 180 and the heel end 190, and a groove 400 may extend a length (L) 402 between the toe end 180 and the heel end 190, respectively. Similar to the groove 200, the grooves 300 and 400 may also vary in depth from one end to another (e.g., a gradual transition). The groove 300 may include a first depth portion 315 associated with a first depth ($D_1$) 310 (FIG. 3), and the groove 400 may include a first depth portion 415 associated with a first depth ($D_1$) 410 (FIG. 4). The first depth portions 315 and 415 may be located in an offset manner relative to a center of the grooves 300 and 400, respectively. In particular, the first depth portion 315 associated with the first depth 310 may be located at or proximate to the heel end 190 whereas the first depth portion 415 associated with the first depth 410 may be located at or proximate to the toe end 180. Accordingly, the maximum depth of the groove 300 may be located at or proximate to the heel end 190 whereas the maximum depth of the groove 400 may be located at or proximate to the toe end 180. As a result, the groove 300 may provide a deeper channel located at or proximate to the heel end 190 relative to the channel located at or proximate to other portions of the groove 300 (e.g., located at or proximate to the toe end 180) to clear out water, sand, grass, and/or other debris between a golf ball (not shown) and the club face 110 before, during, and/or after impact on the club face 110 by the golf ball. In contrast, the groove 400 may provide a deeper channel located at or proximate to the toe end 180 relative to channel (s) located at or proximate to other portions of the groove 400 (e.g., located at or proximate to the heel end 190) to clear out water, sand, grass, and/or other debris between a golf ball (not shown) and the club face 110 before, during, and/or after impact on the club face 110 by the golf ball.

The golf club head 100 may be custom fitted to a particular individual. Referring to FIGS. 1-4, for example, the type of groove of the golf club head 100 may vary. For example, the grooves 120 of the golf club head 100 may include grooves associated with the groove 200 only, grooves associated with the groove 300 only (e.g., for an individual who consistently hits golf balls off the heel end 190 of the golf club head 100), or grooves associated with the groove 400 only (e.g., for an individual who consistently hits golf balls off the toe end 180 of the golf club head 100). Alternatively, the grooves 120 of the golf club head 100 may include grooves of any combination of the groove 200, the groove 300, or the groove 400. In one example, the grooves 122 and 124 may be the groove 400, the groove 126 may be the groove 200, and the groove 128 may be the groove 300. The methods, apparatus, and articles of manufacture described herein are not limited in this regard.

Figure 6:
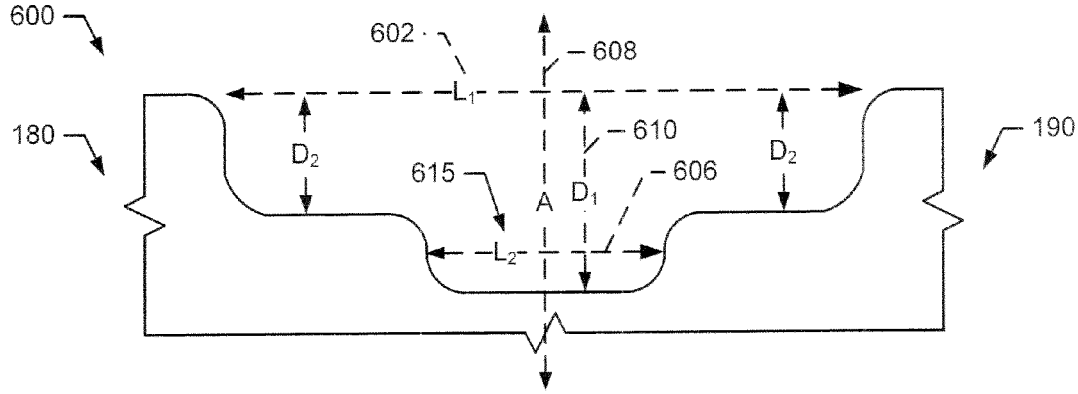
FIG. 6 depicts a cross-sectional view of a fifth example groove along line 1-1.
Figure 7:
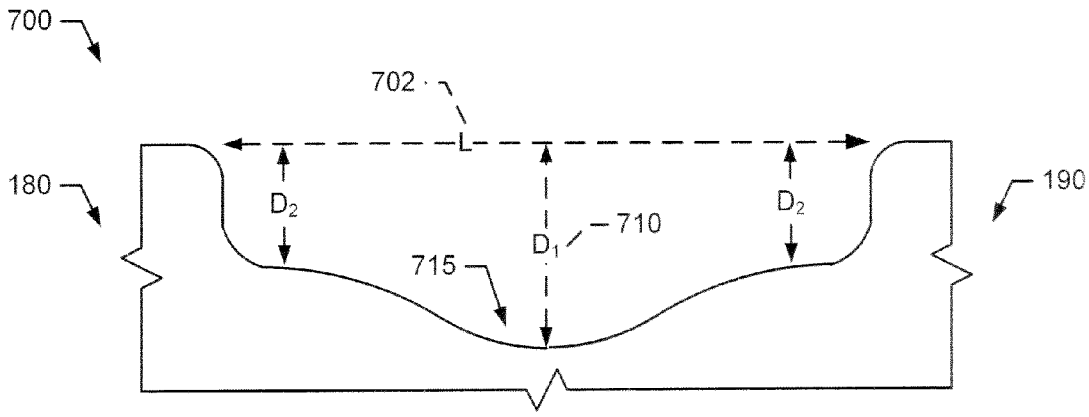
FIG. 7 depicts a cross sectional view of a sixth example groove along line 1-1.
Figure 8:
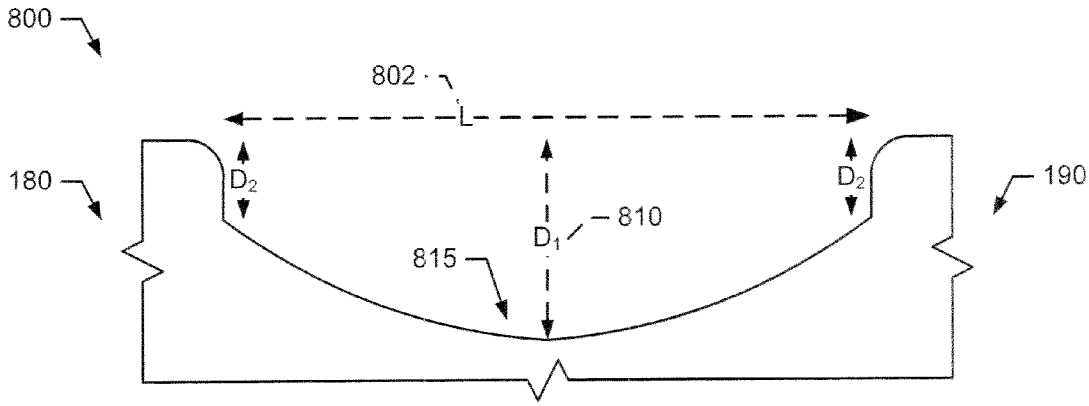
FIG. 8 depicts a cross-sectional view of a seventh example groove along line 1-1.
Figure 9:
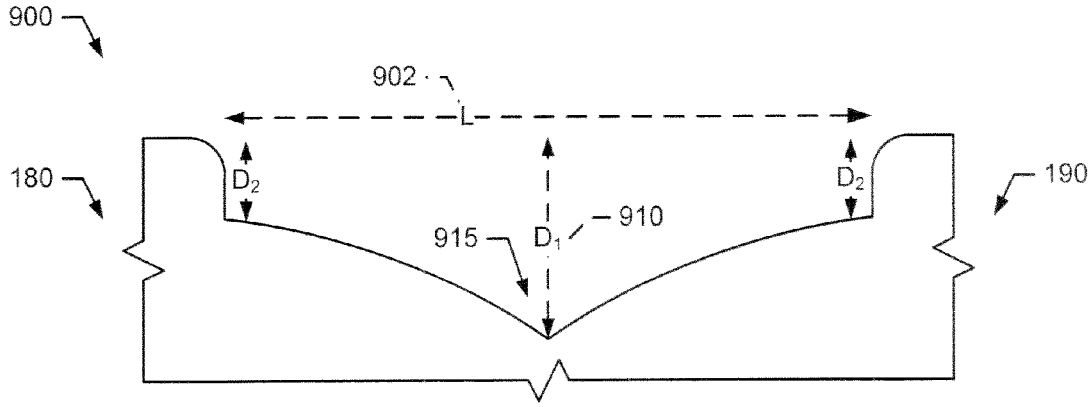
FIG. 9 depicts a top plan view of a first example groove.

While the above figures may depict particular examples of cross-sectional groove configurations extending between the toe end 180 and the heel end 190, the golf club head 100 may include grooves e.g., grooves 500, 600, 700, 800, and 900 of FIGS. 5, 6, 7, 8, and 9, respectively) with other suitable cross-sectional groove configurations. For example, the grooves 500 and 600 (FIGS. 5 and 6, respectively) may include a relatively flat bottom whereas as illustrated in FIGS. 7 and 8, the grooves 700 and 800 (FIGS. 7 and 8, respectively) may include a relatively curved bottom, respectively. Each of the grooves 500, 600, 700, 800, and 900 may include a first depth portion (generally shown as 515, 615, 715, 815, and 915, respectively) associated with a first depth (generally shown as 510, 610, 710, 810, and 910, respectively). Similar to the above examples, each of the first depths ($D_1$) 510, 610, 710, 810, and 910 may be a maximum depth of the grooves 500, 600, 700, 800, and 900, respectively. Although FIGS. 5, 6, 7, 8, and 9 may depict the first depth portions 515, 615, 715, 815, and 915 associated with the first depths being located at or proximate to the center of the grooves 500, 600, 700, 800, and 900, respectively, the first depth portions 515, 615, 715, 815, and 915 may be located at or proximate to the toe end 180 and/or the heel end 190. Further, the depth of the grooves described herein may transition gradually (e.g., the groove 800 of FIG. 8), non-gradually (e.g., the groove 500 of FIG. 5), or a combination thereof in a linear or non-linear manner.

Turning back to FIG. 5, the groove 500 may include two or more depths, generally shown as a first depth ($D_1$) 510, a second depth ($D_2$) 520, and a third depth ($D_3$) 530 (e.g., variable depth). The groove 500 may be symmetrical along the axis (A) 508 (e.g., the second and third depths 520 and 530 are equal to each other). Alternatively, the groove 500 may be asymmetrical along the axis 508 (e.g., the second and third depths 520 and 530 are not equal to each other). The groove 500 may include a first depth portion 515, a second depth portion 525, and third depth portion 535. The first depth portion 515 may be associated with the first depth 510, the second depth portion 525 may be associated with the second depth 520, and the third depth portion 535 may be associated with the third depth 530. The second depth portion 525 may be located at or proximate to the toe end 180 of the groove 500. The third depth portion 535 may be located at or proximate to the heel end 190 of the groove 500. The first depth portion 515 may be located between the second and third depth portions 525 and 535. In contrast to the grooves 200, 300, and 400 (FIGS. 2-4), the groove 500 may not include transition depth portions between the first, second, and third depth portions 515, 525, and 535 (i.e., non-gradual transitions).

The length ($L_2$) 506 of the first depth portion 515 associated with the first depth 510 may be less than half the length ($L_1$) 502 of the groove 500 ($L_2<0.50*L_1$). A majority of the groove 500 may have a depth of less than or equal to 0.020 inches whereas the first depth portion 515 may be associated with the first depth 510, which may be greater than 0.020 inches but less than 0.022 inches at least fifty percent of the groove 500 may have a depth of less than 0.020 inches). As a result, the first depth portion 515 of the groove 500 may provide a deeper channel located at or proximate to a center of the length 502 relative to channels associated with the second and third depth portions 525 and 535 located at or proximate to the toe end 180 and the heel end 190) to clear out water, sand, grass, and/or other debris between a golf ball (not shown) and the club face 110 before, during, and/or after impact on the club face 110 by the golf ball. The methods, apparatus, and articles of manufacture described herein are not limited in this regard.

Referring to FIG. 6, as another example, the groove 600 may include two or more depths, generally shown as a first depth ($D_1$) 610 and a second depth ($D_2$) 620 (e.g., variable depth). The groove 600 may be symmetrical along the axis (A) 608. The length ($L_2$) 606 of the first depth portion 615 associated with the first depth 610 may be less than half the length ($L_1$) 602 of the groove 600 ($L_2<0.50*L_1$). For example, a majority of the groove 600 may have a depth of less than or equal to 0.020 inches whereas the first depth portion 615 may be associated with the first depth 610, which may be greater than 0.020 inches but less than 0.022 inches (e.g., at least fifty percent of the groove 600 may have a depth of less than 0.020 inches). As a result, the first depth portion 615 of the groove 600 may provide a deeper channel located at or proximate to a center of the length 602 relative to the channels located at or proximate to the toe end 180 and the heel end 190 to clear out water, sand, grass, and/or other debris between a golf ball (not shown) and the club face 110 before, during, and/or after impact on the club face 110 by the golf ball. The methods, apparatus, and articles of manufacture described herein are not limited in this regard.

Figure 10:
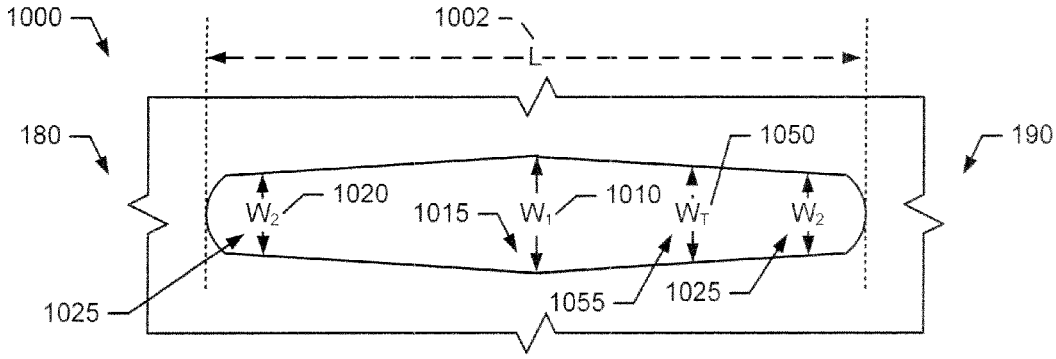
FIG. 10 depicts a top plan view of a second example groove.

In addition or alternatively to variable depth as described above, a groove may vary in width from one end to another. In the example of FIG. 10, a groove 1000 may extend a length (L) 1002 between the toe end 180 and the heel end 190 (FIG. 1). Instead of having a uniform or constant width from end to another (e.g., between the toe end 180 and the heel end 190), the groove 1000 may include two or more widths, generally shown as a first width ($W_1$) 1010 and a second width ($W_2$) 1020 (e.g., variable width). For example, the first and second widths 1010 and 1020 may be measured by using the 30 degrees method of measurement defined by one or more golf standard organizations and/or governing bodies, or other suitable methods of measurement. The groove 1000 may include a first width portion 1015 associated with the first width 1010. The portions of the groove 1000 located at or proximate to the toe end 180 and the heel end 190 may be associated with the second width 1020.

In general, the width of the groove 1000 may gradually transition between the depth portions 1015 and 1025 (e.g., in al near manner). For example, the groove 1000 may include transition widths ($W_T$), generally shown as 1050, which may be associated with a transition width portion(s) 1055. Transition width portion(s) 1055 may extend between the first and second width portions 1015 and 1025. The first width 1010 may be a maximum width of the groove 1000 whereas the second width 1020 may be a minimum width of the groove 1000. Accordingly, the transition width 1050 may be less than the first width 1010 but greater than second width 1020. In one example, the first width 1010 may be greater than 0.035 inches (e.g., $W_1$>0.035 inches). In another example, the first width 1010 may be greater than 0.035 inches but less than 0.037 inches (e.g., 0.035 inches<$W_1$<0.037 inches). The first width portion 1015 associated with the first width 1010 may be less than half the length 1002 of the groove 1000. For example, a majority of the groove 1000 may have a width of less than or equal to 0.035 inches whereas the first width portion 1015 may be associated with the first width 1010, which may be greater than 0.035 inches but less than 0.037 inches (e.g., at least fifty percent of the groove 1000 may have a width of less than 0.035 inches). Although FIG. 10 may depict the first width 1010 being located at or proximate to a center of the length 1002, the first width 1010 may be located at or proximate to other portions of the groove 1000. The methods, apparatus, and articles of manufacture are not limited in this regard.

Figure 11:
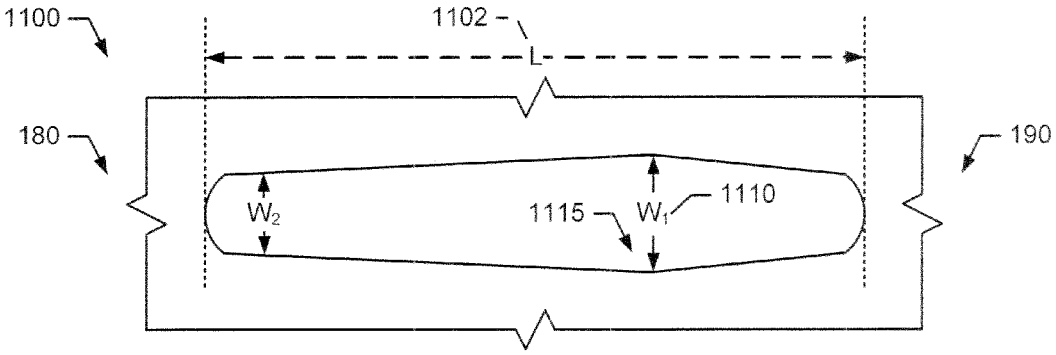
FIG. 11 depicts a top plan view of a third example groove.
Figure 12:
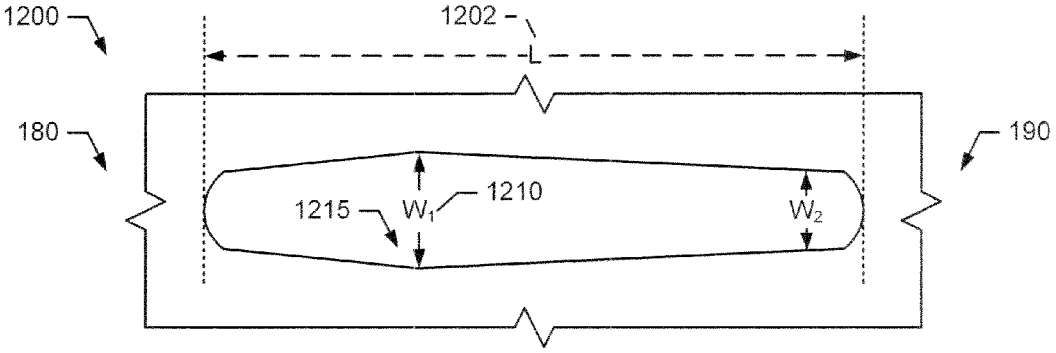
FIG. 12 depicts a top plan view of a fourth example groove.
Figure 13:
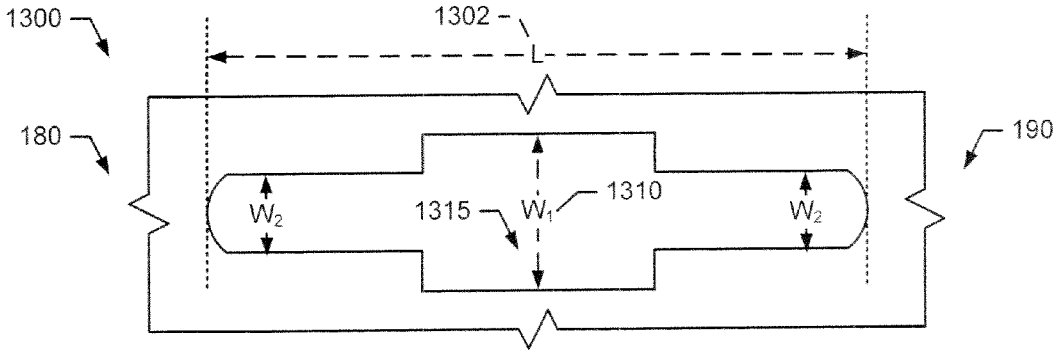
FIG. 13 depicts a top plan view of a fifth example groove.
Figure 14:
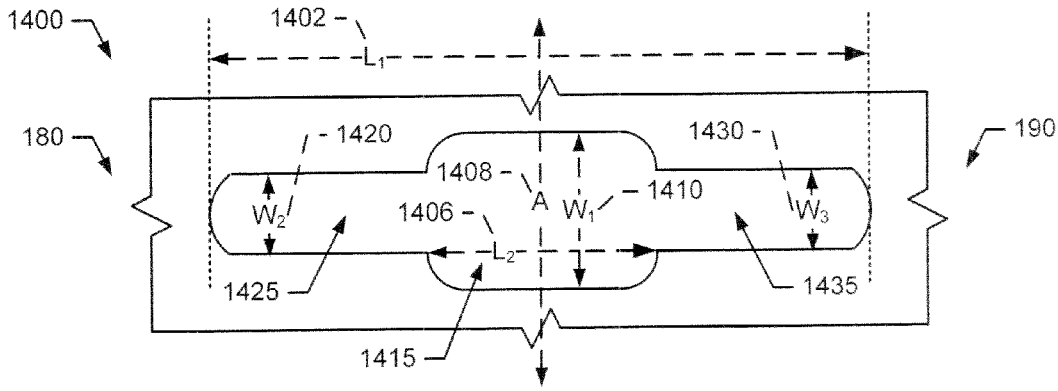
FIG. 14 depicts a top plan view of a sixth example groove.
Figure 15:
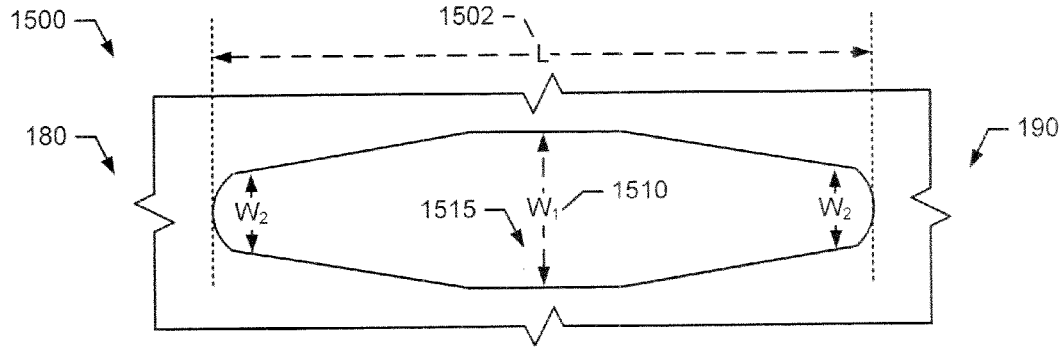
FIG. 15 depicts a top plan view of a seventh example groove.
Figure 16:
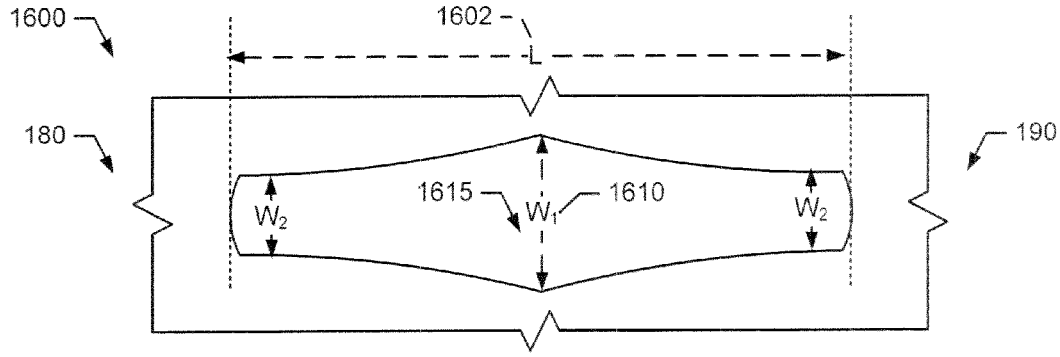
FIG. 16 depicts a top plan view of an eighth example groove.

Turning to FIGS. 11 and 12, for example, a groove 1100 may extend a length (L) 1102 between the toe end 180 and the heel end 190, and a groove 1200 may extend a length (L) 1202 between the toe end 180 and the heel end 190, respectively. Similar to the groove 1000, the grooves 1100 and 1200 may vary in width from one end to another. The groove 1100 may include a first width portion 1115 associated with a first width ($W_1$) 1110 (FIG. 11), and the groove 1200 may include a first width portion 1215 associated with a first width ($W_1$) 1210 (FIG. 12). The first width portions 1115 and 1215 may be located in an offset manner relative to a center of the grooves 1100 and 1200, respectively. In particular, the first width portion 1115 associated with the first width 1110 may be located at or proximate to the heel end 190 whereas the first width portion 1215 associated with the first width 1210 may be located at or proximate to the toe end 180. Accordingly, the maximum width of the groove 1100 may be located at or proximate to the heel end 190 whereas the maximum width of the groove 1200 may be located at or proximate to the toe end 180. The methods, apparatus, and articles of manufacture described herein are not limited in this regard.

While the above figures may depict particular examples of cross-sectional groove configurations extending between the toe end 180 and the heel end 190, the golf club head 100 may include grooves (e.g., grooves 1300, 1400, 1500, and 1600 of FIGS. 13, 14, 15, and 16, respectively) with other suitable top plan configurations. Each of the grooves 1300, 1400, 1500, and 1600 may include a first width portion (generally shown as 1315, 1415, 1515, and 1615, respectively) associated with a first width (generally shown as 1310, 1410, 1510, and 1610, respectively). Similar to the above examples, each of the first widths 1310, 1410, 1510, and 1610 may be a maximum width of the grooves 1300, 1400, 1500, and 1600, respectively. Although FIGS. 13, 14, 15, and 16 may depict the portions 1315, 1415, 1515, and 1615 associated with the first widths being located at or proximate to the center of the grooves 1300, 1400, 1500, and 1600, respectively, the first width portions 1315, 1415, 1515, and 1615 may be located at or proximate to the toe end 180 or the heel end 190. The methods, apparatus, and articles of manufacture described herein are not limited in this regard.

Turning back to FIG. 14, the groove 1400 may include two or more widths, generally shown as a first width ($W_1$) 1410, a second width ($W_2$) 1420, and a third width ($W_3$) 1430 (e.g., variable width). The groove 1400 may be symmetrical along the axis (A) 1408 (e.g., the second and third widths 1420 and 1430 are equal to each other). Alternatively, the groove 1400 may be asymmetrical along the axis 1408 (e.g., the second and third widths 1420 and 1430 are not equal to each other). The groove 1400 may include a first width portion 1415, a second width portion 1425, and third width portion 1435. The first width portion 1415 may be associated with the first width 1410, the second width portion 1425 may be associated with the second width 1420, and the third width portion 1435 may be associated with the third width 1430. The second width portion 1425 may be located at or proximate to the toe end 180 of the groove 1400. The third width portion 1435 may be located at or proximate to the heel end 190 of the groove 1400. The first width portion 1415 may be located between the second and third width portions 1425 and 1435. In contrast to the grooves 1000, 1100, and 1200 (FIGS. 10-12), the groove 1400 may not include transition depth portions between the first, second, and third depth portions 1415, 1425, and 1435 (i.e. non-gradual transitions).

The length ($L_2$) 1406 of the first width portion 1415 associated with the first width 1410 may be less than half the length ($L_1$) 1402 of the groove 1400 ($L_2$<0.50*$L_1$). A majority of the groove 1400 may have a width of less than or equal to 0.035 inches whereas the first width portion 1415 may be associated with the first width 1410, which may be greater than 0.035 inches but less than 0.037 inches (e.g., at least fifty percent of the groove 1400 may have a width of less than 0.035 inches). As a result, the first width portion 1415 of the groove 1400 may provide a deeper channel located at or proximate to a center of the length 1402 relative to channels associated with the second and third width portions 1425 and 1435 (e.g., located at or proximate to the toe end 180 and the heel end 190) to clear out water, sand, grass, and/or other debris between a golf ball (not shown) and the club face 110 before, during, and/or after impact on the club face 110 by the golf ball. The methods, apparatus, and articles of manufacture described herein are not limited in this regard.

Although a particular number of grooves 120 may be depicted in FIG. 1, the golf club head 100 may include various numbers of grooves ranging from three (3) to twenty (20) grooves. Various numbers of the grooves 120 may have a depth greater than 0.020 inches with all of the grooves 120 having a depth less than or equal to 0.022 inches (e.g., less than 10%, less than 20%, less than 30%, less than 40%, etc.). In one example, less than a majority of the grooves 120 may have a depth greater than 0.020 inches with all of the grooves 120 having a depth less than or equal to 0.022 inches. Further, various numbers of the grooves 120 may have a width greater than 0.035 inches with all of the grooves 120 having a width less than or equal to 0.037 inches. In one example, less than a majority of the grooves 120 may have a width greater than 0.035 inches with all of the grooves 120 having a width less than or equal to 0.037 inches. The methods, apparatus, and articles of manufacture described herein are not limited in this regard.

Figure 17:
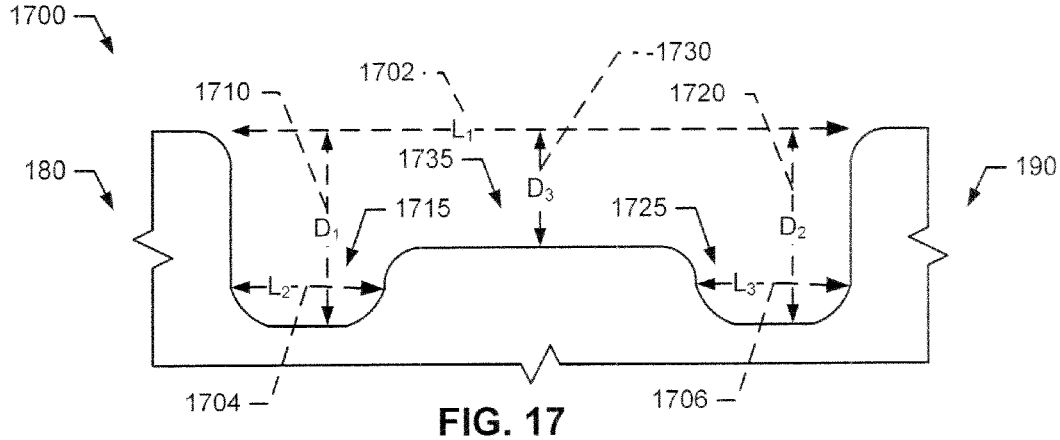
FIG. 17 depicts a cross-sectional view of an eighth example groove along line 1-1.

While the above examples may depict and describe grooves with a single portion having a maximum depth and/or width, the methods, apparatus, and articles of manufacture described herein may include grooves with multiple portions having a maximum depth and or width (e.g., two or more portions). Referring to FIG. 17, for example, a groove 1700 may include two or more depths, generally shown as a first depth ($D_1$) 1710, a second depth ($D_2$) 1720, and a third depth ($D_3$) 1730 (e.g., variable depth). The groove 1700 may include a first depth portion 1715, a second depth portion 1725, and a third depth portion 1735. The first depth portion 1715 may be associated with the first depth 1710, the second depth portion 1725 may be associated with the second depth 1720, and the third depth portion 1735 may be associated with the third depth 1730. The first depth portion 1715 may be located at or proximate to the toe end 180 of the groove 1700. The second depth portion 1725 may be located at or proximate to the heel end 190 of the groove 1700. The third depth portion 1735 may be located between and second depth portions 1715 and 1725.

The groove 1700 may extend a first length ($L_1$) 1702. The first depth portion 1715 may extend a second length ($L_2$) 1704, and the second depth portion 1725 may extend a third length ($L_3$) 1706. In general, the sum of the second and third lengths 1704 and 1706 are less than half of the first length 1702 (e.g., $L_2+L_3<0.5*L_1$). In one example, the second and third lengths 1704 and 1706 may be equal to each other. Alternatively, the second length 1704 may be longer than the third length 1706 or vice versa.

The first depth 1710 may be a maximum depth of the groove 1700. The second depth 1720 may be less than or equal to the first depth 1710, and greater than the third depth 1730. The third depth 1730 may be a minimum depth of the groove 1700. In one example, the first depth 1710 may be greater than 0.020 inches but less than 0.022 inches (e.g., 0.020 inches$<D_1<$0.022 inches). The second depth 1720 may be less than or equal to the first depth 1710, and greater than the third depth 1730. The third depth 1730 may be less than or equal to 0.020 inches (e.g., $D_3 \leqq 0.020$ inches). As a result, the groove 1700 may provide a relatively deeper channel at or proximate to the toe end 180 and the heel end 190 to clear out water sand, grass, and/or other debris between a golf ball (not shown) and the club face 110 before, during, and/or after impact on the club face 110 by the golf ball. The methods, apparatus, and articles of manufacture described herein are not limited in this regard.

Figure 18:
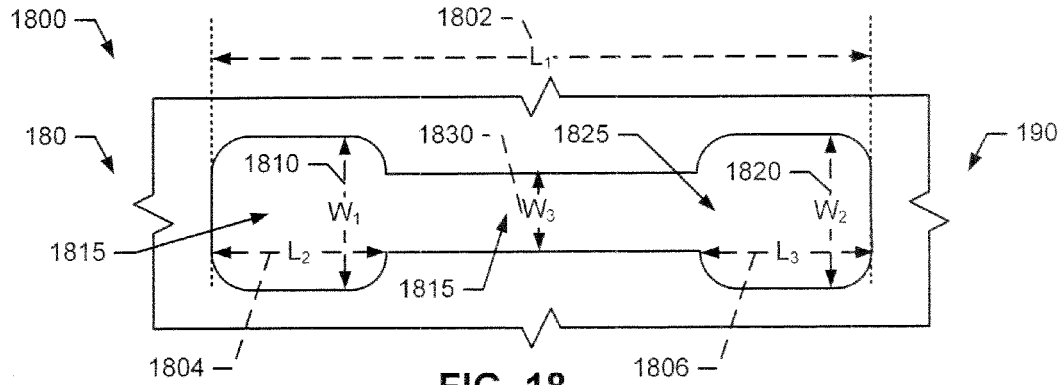
FIG. 18 depicts a top plan view of a ninth example groove.

Turning to FIG. 18, for example, a groove 1800 may include two or more widths, generally shown as a first width ($W_1$) 1810, a second depth ($W_2$) 1820, and a third depth ($W_3$) 1830 (e.g., variable width). The groove 1800 may include a first width portion 1815, a second width portion 1825, and a third width portion 1835. The first width portion 1815 may be associated with the first width 1810, the second width portion 1825 may be associated with the second width 1820, and the third width portion 1835 may be associated with the third width 1830. The first width portion 815 may be located at or proximate to the toe end 180 of the groove 1800. The second width portion 1825 may be located at or proximate to the heel end 190 of the groove 1800. The third width portion 1835 may be located between the first and second width portions 1815 and 1825.

The groove 1800 may extend a first length ($L_1$) 1802. The first width portion 1815 may extend a second length ($L_2$) 1804, and the second width portion 1825 may extend a third length ($L_3$) 1806. In general, the sum of the second and third lengths 1804 and 1806 are less than half of the first length 1802 (e.g., $L_2+L_3<0.5*L_1$). In one example, the second and third lengths 1804 and 1806 may be equal to each other. Alternatively, the second length 1804 may be longer than the third length 1806 or vice versa.

The first width 1810 may be a maximum width of the groove 1800. The second width 1820 may be less than or equal to the first width 1810, and greater than the third width 1830. The third width 1830 may be a minimum width of the groove 1800. In one example, the first width 1810 may be greater than 0.035 inches but less than 0.037 inches e.g., 0.035 inches$<W_1<$0.037 inches). The second width 1820 may be less than or equal to the first width 1810, and greater than the third width 1830. The third width 1830 may be less than or equal to 0.035 inches (e.g., $W_3 \leqq 0.035$ inches). As a result, the groove 1800 may provide a relatively wider channel at or proximate to the toe end 180 and the heel end 190 to clear out water, sand, grass, and/or other debris between a golf ball (not shown) and the club face 110 before, during, and/or after impact on the club face 110 by the golf ball. The methods, apparatus, and articles of manufacture described herein are not limited in this regard.

Figure 19:
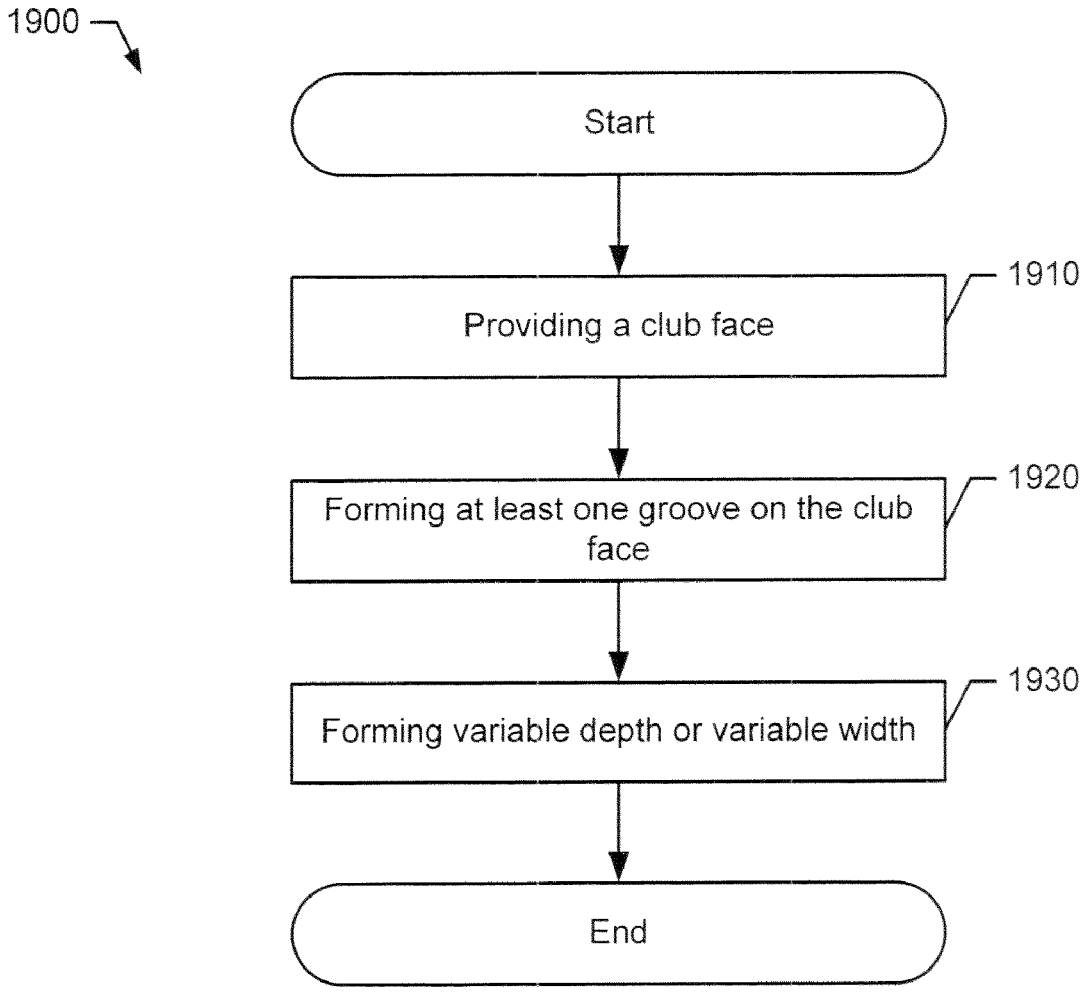
FIG. 19 depicts one manner in which the example golf club head of FIG. 1 may be manufactured.

In the example of FIG. 19, a process 1900 may begin by providing a club face e.g., 110 of FIG. 1) to form a golf club head (e.g., 100 of FIG. 1) (block 1910). In one example, the golf club head 100 may be formed by a casting process and/or any other suitable type of manufacturing techniques or processes. The process 1900 may form at least one groove (e.g., 200 of FIG. 2) on the club face 110 (block 1920). In one example, the groove(s) may be formed by a machining process and/or other suitable type of manufacturing techniques or processes. The process 1900 may form the groove with at least one of a variable depth (e.g., 200 of FIG. 2) or a variable width (e.g., 1200 of FIG. 12) on the club face 110 (block 1930). The variable depth may include a portion with a depth of at least 0.020 inches but less than 0.022 inches. The variable width may include a portion with a width of at least 0.035 inches but less than 0.037 inches. The methods, apparatus, and articles of manufacture described herein are not limited in this regard.

With variable depth and/or variable width, the grooves described herein may increase backspin and/or improve consistency in a variety of playing conditions. Grooves with variable depth and/or variable width as described herein may provide larger channel(s) relative to grooves with substantially uniform depth and/or width to clear out water, sand, grass, and/or other debris between a golf ball (not shown) and the club face 110 before, during, and/or after impact on the club face 110 by the golf ball. The methods, apparatus, and articles of manufacture described herein are not limited in this regard.

Although the process 1900 may be described above with respect to the golf club head 100, the process 100 may be applicable to other golf club heads. In addition, while a particular order of actions is illustrated in FIG. 19, these actions may be performed in other temporal sequences. In particular, two or more actions depicted in FIG. 19 may be performed sequentially, concurrently, or simultaneously. Further, although FIG. 19 may depict a particular number of blocks, the process 1900 may not perform one or more blocks.

As the rules to golf may change from time to time e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Although certain example methods, apparatus, and/or articles of manufacture may have been described herein, the scope of coverage of this disclosure is not limited thereto. On the contrary, this disclosure covers all methods, apparatus, and/or articles of manufacture fairly falling within the scope of the appended claims either literally or under the doctrine of equivalents.

What is claimed is:

1. A golf club head comprising:

a non-hollow body having a club face to engage a golf ball; and at least one groove having a variable depth and extending a length between a first end and a second end of the club face, wherein the variable depth comprises a first depth associated with a first depth portion and a second depth associated with a second depth portion, the first depth being greater than the second depth, the first depth portion extending from a location between the first end and the center to a location between the second end and the center, the second depth portions having same depths and extending between the first end and the first depth portion and extending between the second end and the first depth portion, wherein a greatest depth of the at least one groove is between the first end and the second end and is at least partly offset relative to a center of the length, wherein first depth portion has the same de th as the greatest depth, wherein the depths of the second depth portions are less than the greatest depth, and wherein the first depth portion extends less than half of the length of the at least one groove.

2. A non-hollow golf club head as defined in claim 1, wherein at least a portion of a bottom surface of the groove between the first end and the center is convex relative to the club face and faces away from the first end.

3. A non-hollow golf club head as defined in claim 1, wherein the greatest depth of the at least one groove is substantially at the center.

4. A golf club head comprising:

a club face to engage a golf ball; and at least one variable depth groove having a heel end and a toe end defining a length of the groove, wherein a greatest depth of the at least one groove is between the heel end and the toe end and is at least partly offset relative to a center of the length, is offset relative to the first end and is offset relative to the second end.

5. A golf head as defined in claim 4, wherein the groove comprises:

a first depth portion extending from a location between the heel end and the center to a location between the toe end and the center;

second depth portions having same depths and extending between the heel end and the first depth portion and extending between the toe end and the first depth portion;

wherein first depth portion has the same depth as the greatest depth; and wherein the depths of the second depth portions are less than the greatest depth.

6. A golf club head as defined in claim 5, wherein the groove further comprises third depth portions defining transition portions between the first depth portion and the second depth portions.

7. A golf club head as defined in claim 4, wherein the groove comprises:

a first depth portion extending from a location between the heel end and the center to a location between the toe end and the center;

second depth portions having same depths and extending between the heel end and the first depth portion and extending between the toe end and the first depth portion;

wherein the depths of the second depth portions are the same as the greatest depth; and wherein the depth of the first depth portion is less than the greatest depth.

8. A golf club head as defined in claim 7, wherein the groove further comprises third depth portions defining transition portions between the first depth portion and the second depth portions.

9. A golf club head as defined in claim 4, wherein the greatest depth is greater than 0.020 inches and less than 0.022 inches.

10. A golf club head as defined in claim 4, wherein the greatest depth portion is closer to the center than to the heel end or the toe end.

11. A golf club head comprising:

a club face to engage a golf ball;

at least one groove having a heel end and a toe end defining a length of the groove, a center of the groove being defined by a center of the length;

wherein at least a portion of a bottom surface of the groove between the heel end and the center is convex relative to the club face and faces away from the heel end and faces generally toward the toe end, or wherein at least a portion of the bottom surface of the groove between the toe end and the center is convex relative to the club face and faces away from the toe end and faces generally toward the heel end.

12. A golf club head as defined in claim 11, wherein a greatest depth of the at least one groove is substantially at the center.

13. A golf club head as defined in claim 11, wherein the groove comprises:

a first depth portion extending from a location between the heel end and the center to a location between the toe end and the center;

second depth portions having same depths and extending between the heel end and the first depth portion and extending between the toe end and the first depth portion;

wherein at least a portion of the first depth portion has the same depth as a greatest depth of the at least one groove; and wherein the depths of the second depth portions are less than the greatest depth.

14. A golf club head as defined in claim 13, wherein the groove further comprises third depth portions defining transition portions between the first depth portion and the second depth portions.

15. A golf club head as defined in claim 11, wherein the groove comprises:

a first depth portion extending from a location between the heel end and the center to a location between the toe end and the center;

second depth portions having same depths and extending between the heel end and the first depth portion and extending between the toe end and the first depth portion;

wherein the depth of at least a portion of each of the second depth portions is the same as a greatest depth of the at least one groove; and wherein the depth of the first depth portion is less than the greatest depth.

16. A golf club head as defined in claim 15, wherein the groove further comprises third depth portions defining transition portions between the first depth portion and the second depth portions.

17. A golf club head as defined in claim 11, wherein a greatest depth of the at least one groove is greater than 0.020 inches and less than 0.022 inches.

18. A golf club head as defined in claim 11, wherein a greatest depth of the at least one groove is closer to the center than to the heel end or the toe end.

19. A method of forming a club head comprising:

providing a club face to engage a golf ball; and forming at least one variable depth groove having a heel end and a toe end defining a length of the groove, wherein a greatest depth of the at least one groove is between heel end and the toe end and is at least partly offset relative to a center of the length, is offset relative to the first end and is offset relative to the second end.

20. The method as defined in claim 19, wherein forming the at least one variable depth groove comprises forming a depth portion associated with a depth greater than 0.020 inches but less than 0.022 inches.

* * * * *